US010460598B2

(12) United States Patent
Kashiwakura et al.

(10) Patent No.: US 10,460,598 B2
(45) Date of Patent: Oct. 29, 2019

(54) DRIVING ACTION CLASSIFYING APPARATUS AND DRIVING ACTION CLASSIFYING METHOD

(71) Applicant: TOYOTA JIDOSHA KABUSHIKI KAISHA, Toyota-shi, Aichi (JP)

(72) Inventors: Toshiki Kashiwakura, Tokyo (JP); Yusuke Tanaka, Obu (JP); Chihiro Sannomiya, Yokohama (JP); Keisuke Kurihara, Yamato (JP); Tadahiro Kashiwai, Chofu (JP); Ryo Neyama, Tokyo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 287 days.

(21) Appl. No.: 15/300,350

(22) PCT Filed: Apr. 8, 2015

(86) PCT No.: PCT/JP2015/001983

§ 371 (c)(1),
(2) Date: Sep. 29, 2016

(87) PCT Pub. No.: WO2015/155990

PCT Pub. Date: Oct. 15, 2015

(65) Prior Publication Data

US 2017/0148311 A1 May 25, 2017

(30) Foreign Application Priority Data

Apr. 10, 2014 (JP) ..... 2014-081263

(51) Int. Cl.
*G08G 1/01* (2006.01)
*G08G 1/0967* (2006.01)

(52) U.S. Cl.
CPC ..... *G08G 1/0112* (2013.01); *G08G 1/0129* (2013.01); *G08G 1/0133* (2013.01);
(Continued)

(58) Field of Classification Search
CPC ..... G08G 1/0112; G08G 1/096708; G08G 1/096716; G08G 1/096725; G01G 1/0129
See application file for complete search history.

(56) References Cited

U.S. PATENT DOCUMENTS

2006/0058940 A1 3/2006 Kumagai et al.
2009/0076774 A1 3/2009 Miyajima
(Continued)

FOREIGN PATENT DOCUMENTS

CN 101965601 A 2/2011
EP 2570773 A1 3/2013
(Continued)

*Primary Examiner* — Curtis B Odom
(74) *Attorney, Agent, or Firm* — Oliff PLC

(57) ABSTRACT

A driving action classifying apparatus has a driving-action-symbol acquiring unit configured to acquire position information on a vehicle and driving action symbols, which are data obtained by converting driving actions of the vehicle into symbols; and a tendency symbolizing unit configured to collect the driving action symbols corresponding to a same or similar place acquired from a plurality of vehicles and generate driving tendency symbols, which are data obtained by converting into a symbol a frequency distribution of the driving action symbols.

17 Claims, 14 Drawing Sheets

(52) U.S. Cl.
CPC ..... *G08G 1/0141* (2013.01); *G08G 1/096716* (2013.01); *G08G 1/096741* (2013.01); *G08G 1/096775* (2013.01)

(56) References Cited

U.S. PATENT DOCUMENTS

| | | | | |
|---|---|---|---|---|
| 2010/0309022 | A1 | 12/2010 | Ishikawa | |
| 2010/0324806 | A1* | 12/2010 | Ishikawa | G08G 1/0104 701/119 |
| 2011/0301802 | A1* | 12/2011 | Rupp | G08G 1/0112 701/408 |
| 2013/0226622 | A1 | 8/2013 | Adamson et al. | |
| 2015/0081149 | A1 | 3/2015 | Takahashi et al. | |
| 2017/0032673 | A1* | 2/2017 | Scofield | G08G 1/0112 |

FOREIGN PATENT DOCUMENTS

| | | | |
|---|---|---|---|
| JP | H09-189565 | A | 7/1997 |
| JP | 2006-079483 | A | 3/2006 |
| JP | 2009-075647 | A | 4/2009 |
| JP | 2010-221962 | A | 10/2010 |
| JP | 2013-117809 | A | 6/2013 |
| JP | WO2013/137103 | A1 | 9/2013 |
| JP | 2014-016883 | A | 1/2014 |
| WO | 2009/118987 | A1 | 10/2009 |

* cited by examiner

DRIVING ACTION DATA

| ID | VEHICLE ID | DATE AND TIME | POSITION INFORMATION | DRIVING ACTION SYMBOL |
|---|---|---|---|---|
| 1 | A0001 | 2014/3/1 13:30 | ROAD A POINT 1 | A |
| 2 | A0001 | 2014/3/1 13:30 | ROAD A POINT 2 | B |
| 3 | A0001 | 2014/3/1 13:31 | ROAD A POINT 3 | C |
| 4 | A0001 | 2014/3/1 13:31 | ROAD A POINT 4 | D |
| 5 | A0002 | 2014/3/1 14:00 | ROAD A POINT 1 | C |
| 6 | A0002 | 2014/3/1 14:00 | ROAD A POINT 2 | B |
| 7 | A0002 | 2014/3/1 14:00 | ROAD A POINT 3 | D |
| 8 | A0002 | 2014/3/1 14:01 | ROAD A POINT 4 | A |
| ... | ... | ... | ... | ... |

FIG. 7

DRIVING TENDENCY DATA

| ID | POSITION INFORMATION | DRIVING TENDENCY SYMBOL |
|---|---|---|
| 1 | ROAD A / SECTION 1 | A |
| 2 | ROAD A / SECTION 2 | A |
| 3 | ROAD A / SECTION 3 | B |
| 4 | ROAD A / SECTION 4 | B |
| 5 | ROAD A / SECTION 5 | C |
| 6 | ROAD A / SECTION 6 | B |
| 7 | ROAD A / SECTION 7 | B |
| 8 | ROAD A / SECTION 8 | B |
| ... | ... | ... |

FIG. 9

DRIVING ACTION CLASSIFYING APPARATUS AND DRIVING ACTION CLASSIFYING METHOD

TECHNICAL FIELD

The present invention relates to an apparatus that classifies driving actions of a driver.

BACKGROUND ART

Researches have been conducted concerning a technique for providing information for safe driving using sensor information collected from a vehicle and a roadside.

For example, Patent Literature 1 describes a system in which an apparatus set on a roadside detects that a behavior of a passing vehicle is dangerous, generates risk information on the basis of a ratio of the number of vehicles, in which dangers are detected, to the number of passing vehicles, and delivers the risk information to vehicles that pass a dangerous point.

Patent Literature 2 describes a system that acquires, when a dangerous event such as a near miss occurs in a vehicle, information such as a position and speed from a portable information terminal located around the vehicle, determines whether the vehicle is involved in the event, and then registers information concerning the dangerous event in a database.

When these inventions are used, it is possible to automatically collect information concerning points where dangerous events tend to occur. It is possible to improve safety by distributing these kinds of information to following vehicles.

CITATION LIST

Patent Literature

Patent Literature 1: Japanese Patent Application Laid-open No. 2014-16883

Patent Literature 2: Japanese Patent Application Laid-open No. 2013-117809

SUMMARY OF INVENTION

In the techniques explained above, a dangerous place is specified by detecting that some dangerous event has occurred in a vehicle. However, in these inventions, information cannot be collected unless a dangerous driving action such as "passing without noticing a stop sign" or "noticing rush-out and applying sudden brake" occurs.

On the other hand, when a driver travels on an unfamiliar road, the driver often desires information concerning what the driver should pay attention during driving. The information is, for example, information "since there are many parking vehicles, evasive actions need to be frequently taken" or information "since visibility is poor, speed needs to be greatly reduced". However, such information concerning "a point where a dangerous event did not occur in the past but attention needs to be paid" cannot be collected by the conventional techniques.

The present invention has been devised taking into account the problems and it is an object of the present invention to provide a driving action classifying apparatus that typifies driving actions taken by a driver.

In order to solve the problems, a driving action classifying apparatus adopts a configuration for acquiring driving actions taken by drivers who pass a certain point and converting driving actions acquired from a plurality of vehicles into symbols having meanings.

The present invention in its one aspect provides a driving action classifying apparatus comprises a driving-action-symbol acquiring unit configured to acquire position information on a vehicle and driving action symbols, which are data obtained by converting driving actions of the vehicle into symbols; and a tendency symbolizing unit configured to collect the driving action symbols corresponding to a same or similar place acquired from a plurality of vehicles and generate driving tendency symbols, which are data obtained by converting into a symbol a frequency distribution of the driving action symbols.

The driving action symbol is a symbol representing, as a symbol or a value, a driving action taken by a driver. The driving action symbol to be acquired may correspond to any point or may correspond to any section.

The tendency symbolizing unit is means for acquiring, from a plurality of vehicles, driving action symbols corresponding to the same or similar place and converting into a symbol a frequency distribution of the driving action symbols to generate driving tendency symbols. The driving tendency symbols are symbols obtained by converting into a symbol a distribution of driving action symbols corresponding to a plurality of drivers. That is, the driving tendency symbols are data obtained by typifying driving actions taken by the plurality of drivers in the place. Note that the same place does not always need to be the same point and may be the same section or may include slight deviation. The same place may be defined as a place different for each traffic lane. The similar place is a place where characteristics of a road are similar. The characteristics are, for example, the width of the road, the number of traffic lanes, buildings around the road, and a distance from a crossing.

According to such a configuration, it is possible to classify driving actions taken as an overall tendency by drivers who pass a certain place on a road or a place having characteristics similar to characteristics of the place.

The driving-action-symbol acquiring unit may include a sensor-data collecting unit configured to acquire, from a vehicle including a sensor, sensor data and position information on the vehicle at time when the sensor data is generated; and an action symbolizing unit configured to generate, on the basis of the acquired sensor data, driving action symbols, which are data obtained by converting the sensor data into symbols.

In this way, the driving action symbols may be generated on the basis of sensor data acquired from a vehicle. The sensor data is information that can be acquired from a sensor provided in the vehicle and relates to a behavior of the vehicle or driving operation performed by a driver. The sensor data is typically speed, acceleration, a steering angle, a yaw rate, and the like of the vehicle. However, the sensor data is not limited thereto.

The action symbolizing unit is means for receiving the sensor data as an input and converting the sensor data into symbols to generate driving action symbols.

For example, the converting into symbols may be performed by clustering one or more sensor data or may be performed by classifying one or more sensor data according to any method.

The converting into symbols may be performed targeting sensor data generated at a certain point in time or may be performed targeting sensor data generated in traveling in a certain section.

The driving action classifying apparatus may further comprise a point specifying unit configured to specify, on the basis of a change of the driving tendency symbols and position information corresponding to the driving tendency symbols, a place where a peculiar driving action has occurred.

In this way, a place where a peculiar driving action has occurred may be specified on the basis of a change of the driving tendency symbols. The change of the driving tendency symbols means that many drivers change driving actions. That is, it is possible to estimate a place where some driving action such as a route change or deceleration tends to occur. It is possible to specify, referring to position information corresponding to the driving tendency symbols, a point where attention is necessary for traveling.

In the case where the driving tendency symbols locally change in a certain place, the point specifying unit may estimate that the peculiar driving action has occurred in the place.

The local change of the driving tendency symbols indicates that, after the driving tendency symbols has changed, the driving tendency symbols has returned to original values within a predetermined time or distance. In such a case, it is estimated that the driver has taken some action during traveling because of an external factor. Therefore, it can be determined that a peculiar driving action has occurred in the place.

The driving action classifying apparatus may further comprise a point specifying unit configured to specify, on the basis of a state of divergence between the acquired driving action symbols and the driving tendency symbols in places corresponding the driving action symbols, a place where a peculiar driving action has occurred.

Even when the driving tendency symbols has not locally changed, when a part of vehicles takes a driving action contrary to the overall tendency, it is possible to determine that a peculiar driving action has occurred in the place. The driving tendency symbols are symbols corresponding to the frequency distribution of the driving action symbols. Therefore, by acquiring a state of divergence between target driving action symbols and the frequency distribution, it is possible to determine that driving contrary to the overall tendency has been performed. Note that a criterion for the determination may be a divergence degree of the driving action symbols or may be the number (a ratio) of vehicles, driving action symbols of which diverge.

The driving action classifying apparatus may further comprise a second position-information acquiring unit configured to acquire position information on a second vehicle; and a notifying unit configured to transmit notification to the second vehicle when the position information acquired by the second position-information acquiring unit relates to a position in a vicinity of the place where the peculiar drive action has occurred as specified by the point specifying unit.

Whereas the first vehicle is a vehicle that provides information (a probe car), the second vehicle is a vehicle that receives the provision of the information. The driving action classifying apparatus receives position information from the second vehicle and, when the position is in the vicinity of a place where it is determined that a peculiar driving action has occurred, transmits notification to the second vehicle. According to such a configuration, a driver of the second vehicle can grasp that the driver is traveling in the vicinity of a place where attention is necessary for driving. Note that the first vehicle and the second vehicle may be the same vehicle.

The driving action classifying apparatus may further comprise an additional-information storing unit configured to store additional information corresponding to the driving tendency symbols, wherein the notifying unit transmits, together with the notification, additional information corresponding to the driving tendency symbols to the second vehicle.

The additional information corresponding to the driving tendency symbols is, for example, information indicating what causes a peculiar driving action. According to such a configuration, since the driver of the second vehicle can grasp a target for which attention is necessary, it is possible to further improve safety.

The driving-action-symbol acquiring unit may classify the position information into a plurality of segments and acquires the driving action symbols for each of the segments, and the tendency symbolizing unit may convert into a symbol the frequency distribution of the driving action symbols for each of the segments.

The segment is a predetermined section of a road divided for, for example, each predetermined distance. By generating the driving action symbols for each section in this way, the user can obtain information of desired accuracy.

The driving-action-symbol acquiring unit may associate attributes concerning situations during vehicle traveling with the acquired driving action symbols, and the tendency symbolizing unit may generate the driving tendency symbols, using the driving action symbols associated with attributes designated by a user.

The attributes concerning the situation during the vehicle traveling are, for example, a period of time when the vehicle travels, a car model, an age of a driver who drives the vehicle, and length of a driving experience of the driver. The driver who drives the vehicle sometimes shows a different driving action for each of these attributes. Therefore, when receiving designation of the attributes from the user and converting into a symbol the frequency distribution of the driving action symbols, the tendency symbolizing unit may extract, through filtering, only the driving action symbols associated with the designated attributes.

Note that the attributes are not limited to the illustrated attributes. For example, weather, a congestion state of a road, a vehicle following distance, the number of parking vehicles, and the number of pedestrians may be used.

The attributes concerning the situations during the vehicle traveling may be periods of time when the vehicle travels. The attributes concerning the situations during the vehicle traveling may be attributes of a driver who drives the vehicle.

The period of time is, for example, time or a day of the week or a division of a weekday or a holiday. However, the period of time is not limited thereto. When the attributes of the driver such as the number of years of driving experience, sex, and age can be acquired, the tendency symbolizing unit may perform the filtering using the attributes.

The sensor data may include a plurality of data generated by a plurality of sensors, and the action symbolizing unit may cluster the plurality of data to generate the driving action symbols. The sensor data may be at least one of speed, acceleration, a steering angle, and a yaw rate.

When the plurality of kinds of sensor data are converted into symbols in this way, it is preferable to perform the clustering. As a method of the clustering, any method can be used.

Note that the present invention can be specified as a driving action classifying apparatus including at least a part of the means explained above. The present invention can also be specified as a control method for the driving action classifying apparatus. The present invention can also be specified as a vehicle-mounted terminal that transmits a driving action symbol to the driving action classifying apparatus. The processing and the means explained above can be freely combined and carried out as long as no technical contradiction occurs.

According to the present invention, it is possible to provide a driving action classifying apparatus that typifies driving actions taken by a driver.

BRIEF DESCRIPTION OF DRAWINGS

FIG. 7 is an example of driving action data stored in a storing unit.

FIG. 9 is an example of driving tendency data stored in the storing unit.

DESCRIPTION OF EMBODIMENTS

First Embodiment

<System Configuration>

Preferred embodiments of the present invention are explained below with reference to the drawings.

An information providing system according to a first embodiment is a system including a vehicle-mounted apparatus 10 mounted on a vehicle and an information providing apparatus 20. The information providing system is a system that classifies, on the basis of information transmitted from the vehicle-mounted apparatus, driving actions of a driver for each of sections forming a road and outputs information concerning a point where attention is necessary for driving.

Figure 1:
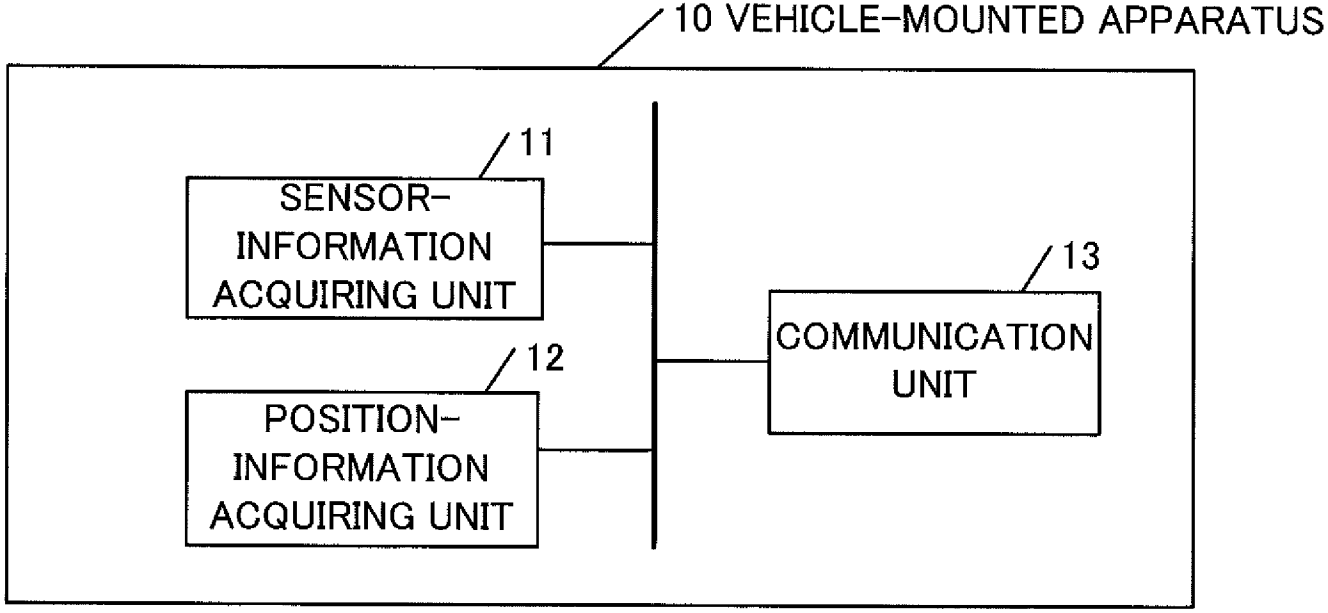
FIG. 1 is a system configuration diagram of a vehicle-mounted apparatus according to a first embodiment.
Figure 2:
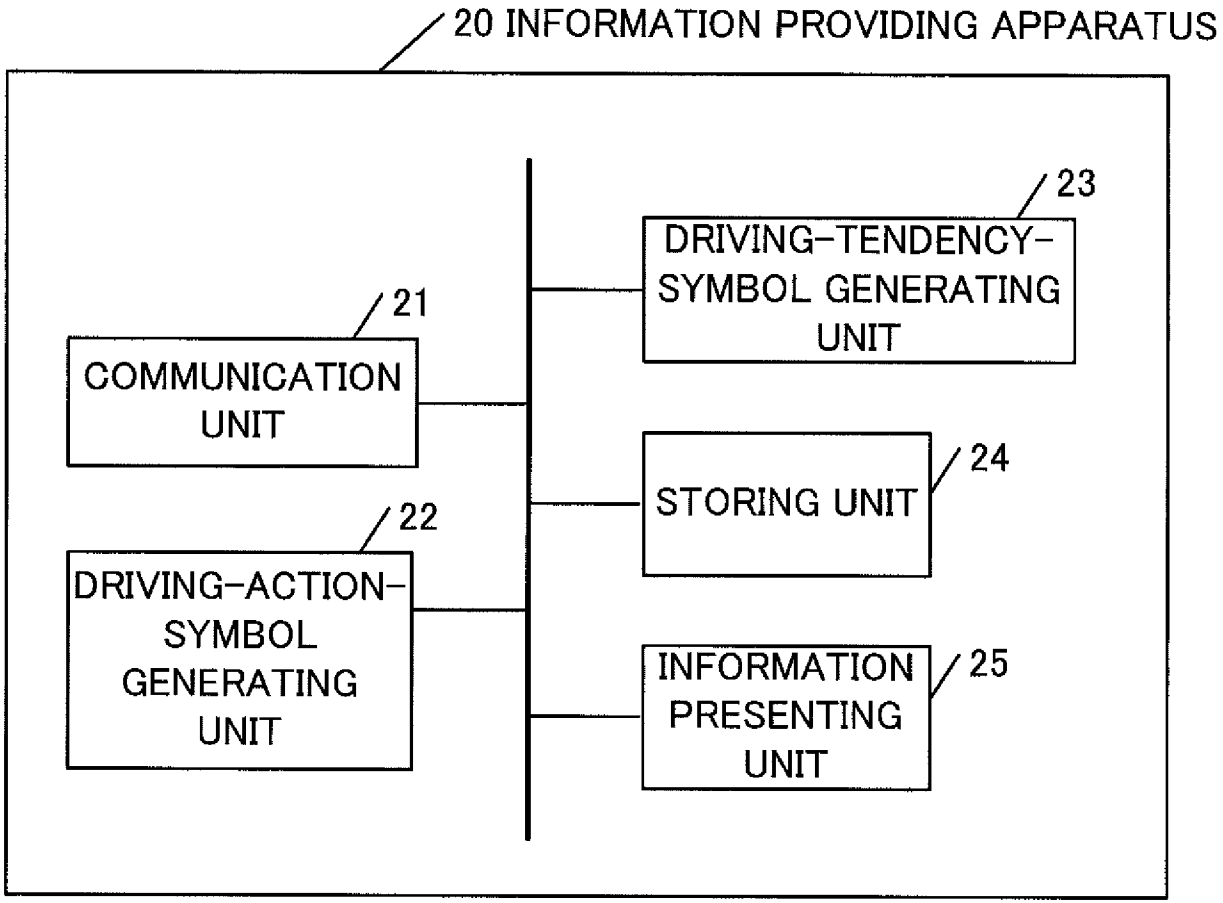
FIG. 2 is a system configuration diagram of an information providing apparatus according to the first embodiment.

FIG. 1 is a system configuration diagram of the vehicle-mounted apparatus 10 according to this embodiment. FIG. 2 is a system configuration diagram of the information providing apparatus 20 according to this embodiment.

First, the vehicle-mounted apparatus 10 is explained. The vehicle-mounted apparatus 10 is an apparatus that transmits information concerning a behavior of a vehicle mounted with the own apparatus to the information providing apparatus 20 together with position information. The vehicle-mounted apparatus 10 is configured from a sensor-information acquiring unit 11, a position-information acquiring unit 12, and a communication unit 13.

The sensor-information acquiring unit 11 is means for acquiring values (hereinafter, sensor values) from a plurality of sensors mounted on the vehicle. The sensors mounted on the vehicle are sensors that acquire a behavior of the vehicle and are, for example, a speed sensor, an acceleration sensor, a yaw rate sensor, and a steering angle sensor. However, the sensors are not limited to these sensors. The sensor-information acquiring unit 11 has a function of filtering the acquired plurality of sensor values. Filtered information is referred to as sensor information.

The position-information acquiring unit 12 is means for acquiring the present position of the apparatus. The position-information acquiring unit 12 can acquire, with a GPS device or the like incorporated therein, position information (latitude and longitude) of the vehicle-mounted apparatus 10.

The communication unit 13 is means for transmitting the sensor information acquired by the sensor-information acquiring unit 11 and the position information acquired by the position-information acquiring unit 12 to the information providing apparatus 20. If information can be transmitted by radio communication, a protocol and a communication method used by the communication unit 13 are not particularly limited.

The information providing apparatus 20 is explained. The information providing apparatus 20 is an apparatus that receives information transmitted from the vehicle-mounted apparatus 10, classifies driving actions of a driver for each of sections forming a road, and outputs information concerning a point where attention is necessary for driving (hereinafter, point-of-attention information). The information providing apparatus 20 is configured from a communication unit 21, a driving-action-symbol generating unit 22, a driving-tendency-symbol generating unit 23, a storing unit 24, and an information presenting unit 25.

The communication unit 21 is means for receiving the sensor information and the position information transmitted from the vehicle-mounted apparatus 10. A protocol and a communication method used by the communication unit 21 are the same as the protocol and the communication method used by the communication unit 13.

The driving-action-symbol generating unit 22 is means for converting into symbols, on the basis of sensor information acquired from the vehicle, driving actions taken by a driver who is driving the vehicle. The symbolized driving actions taken by the driver are referred to as driving action symbols. The driving action symbols can be obtained by, for example, clustering the sensor information acquired from the vehicle.

The driving action symbols can be acquired targeting any time or section such as "t+1 seconds from time t" or "30 m ahead from a point A".

The driving action symbol generated by the driving-action-symbol generating unit 22 is a driving action symbol corresponding to one vehicle.

The driving-tendency-symbol generating unit 23 is means for acquiring a tendency of driving actions on the basis of the driving action symbols acquired by the driving-action-symbol generating unit 22. Specifically, the driving-tendency-symbol generating unit 23 collects driving action symbols corresponding to a plurality of drivers and generates driving tendency symbols, which are symbols representing a tendency of driving actions.

The driving action symbols represent driving actions corresponding to one vehicle. However, a tendency of driving actions taken by the plurality of drivers can be typified by the driving-tendency-symbol generating unit 23. That is, it is possible to obtain data representing what kind of driving action tends to be taken at a target point. The driving tendency symbols can be obtained by, for example, clustering driving action symbols collected from different vehicles at the same point.

The storing unit 24 is a nonvolatile storage medium in which the sensor information, the position information, the driving action symbols, the driving tendency symbols, and the like acquired as explained above are stored. As the storing unit 24, it is preferable to use a storage medium that can be read and write at high speed and has a large capacity. For example, a flash memory can be suitably used. A roadmap provided to the user is stored in the storing unit 24.

The information presenting unit 25 is means for acquiring input operation performed by the user from an input device (not shown in the figure) and generating information to be presented to the user and then outputting the information to a display screen (not shown in the figure).

The control of the means explained above is realized by a processing device (not shown in the figure) such as a CPU executing a control program. The function may be realized by an FPGA (Field-programmable Gate Array), an ASIC (Application Specific Integrated Circuit), or the like or may be realized by a combination thereof.

<Acquisition of Sensor Information>

The processing performed by the information providing apparatus 20 according to this embodiment is mainly divided into three; processing for acquiring sensor information from a vehicle, processing for generating driving action symbols using the sensor information, and processing for generating driving tendency symbols from driving action symbols corresponding to a plurality of vehicles. Overviews of the kinds of processing are explained below.

Figure 3:
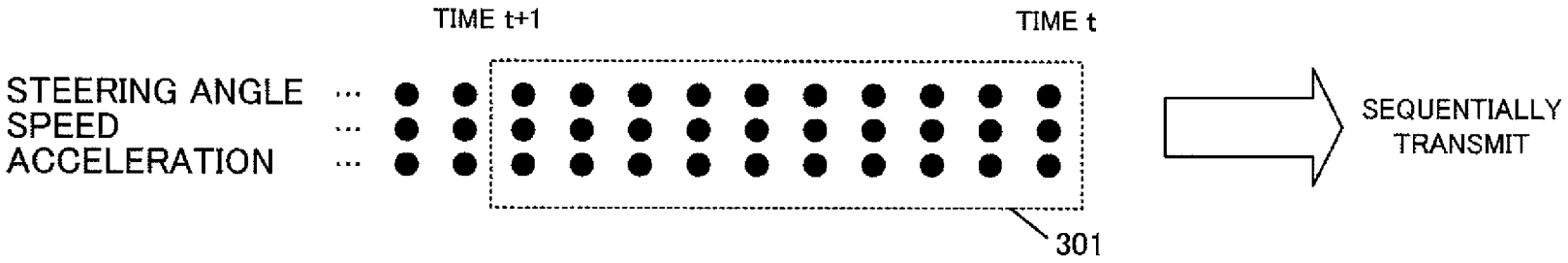
FIG. 3 is a diagram for explaining sensor information acquired by a sensor-information acquiring unit.

First, the processing in which the sensor-information acquiring unit 11 acquires sensor information is explained with reference to FIG. 3.

The sensor-information acquiring unit 11 acquires sensor values from a plurality of sensors included in the vehicle at a predetermined sampling rate (e.g., 10 Hz). Note that the sensor values may be acquired at a sampling rate higher than a target sampling rate and then smoothed by a filter. For example, the sensor values may be sampled at 100 Hz and then down-sampled at 10 Hz by a Gaussian filter or the like. In this embodiment, the sensor values are down-sampled to 10 Hz.

Note that, in this embodiment, three sensors for a steering angle, speed, and acceleration are used. That is, ten sensor values are obtained per second concerning each of the three sensors. Therefore, thirty sensor values are transmitted to the information providing apparatus 20 as sensor information per second (Reference numeral 301).

When receiving the sensor information from the vehicle via the communication unit 21, the information providing apparatus 20 temporarily stores the sensor information. The sensor information is stored as a three-dimensional vector having elements, each corresponding to ten sensor values.

<Generation of Driving Action Symbols>

Figure 4:
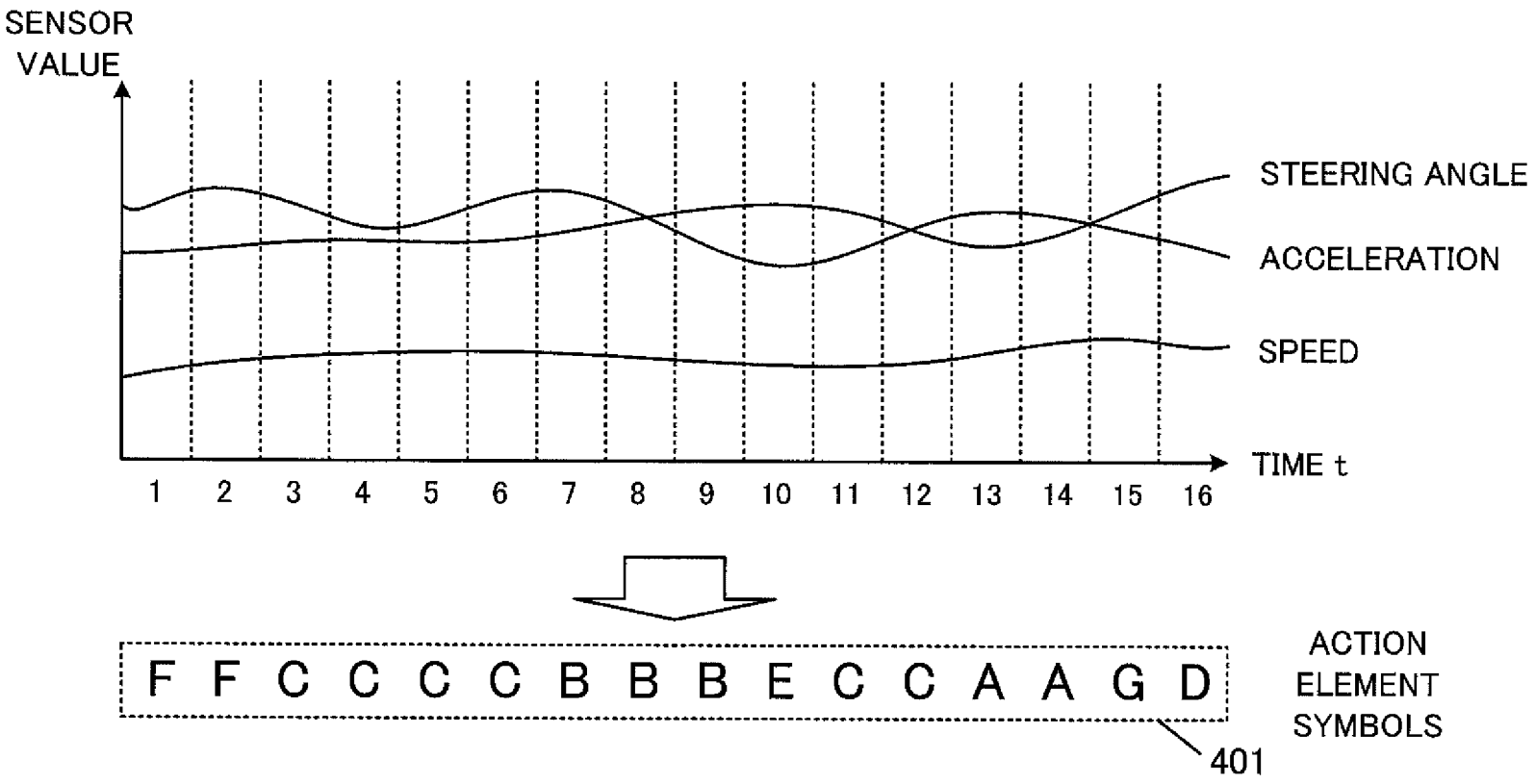
FIG. 4 is a diagram for explaining generation of action element symbols.

The processing in which the driving-action-symbol generating unit 22 generates driving action symbols is explained with reference to FIG. 4.

The processing for generating driving action symbols is divided into two; processing for generating an action element symbol and processing for generating driving action symbols. First, the action element symbol is explained.

The action element symbol is a symbol representing a behavior of the vehicle in an extremely short time (in this embodiment, one second). The action element symbol can be obtained by clustering sensor information (a three-dimensional vector having information for one second) generated in a certain vehicle. As a result, a string of action element symbols indicated by reference numeral 401 is obtained. Reference numeral 401 represents action element symbols for sixteen seconds (1 second×16 action element symbols). Note that, as the clustering, for example, any method such as K-means clustering (K-means) or spectral clustering can be used. Classification may be performed using other methods as long as a classification result can be obtained using the sensor information as an input. A combination of the classification and the clustering may be used. For example, a remainder of processing by a support vector machine (SVM) may be processed by the K-means.

The action element symbols are information for one second. Therefore, a human intension is hardly included therein. Therefore, symbols including a human intension are generated by setting a long period. The symbols are driving action symbols.

Figure 5:
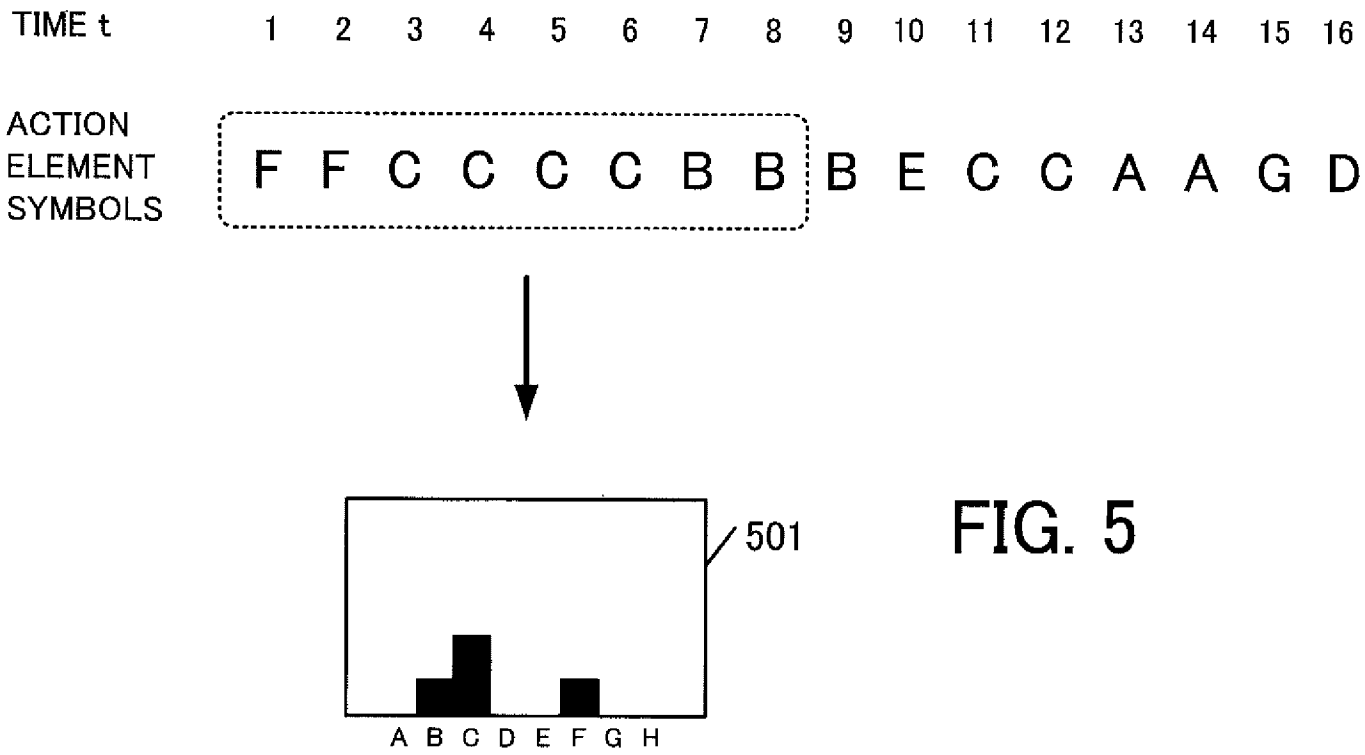
FIG. 5 is a diagram for explaining generation of a histogram of the action element symbols.
Figure 6:
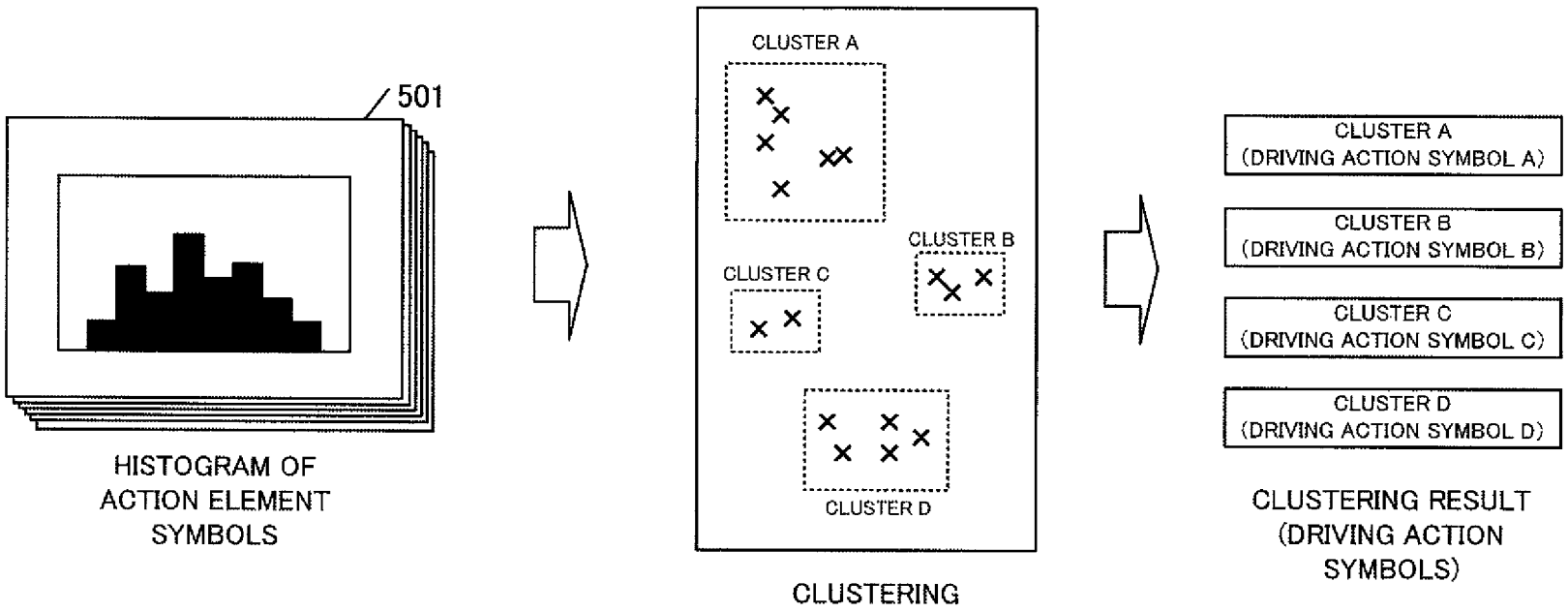
FIG. 6 is a diagram for explaining generation of driving action symbols.

In this embodiment, the driving-action-symbol generating unit 22 generates the driving action symbols from action element symbols for eight seconds. Specifically, first, as shown in FIG. 5, the driving-action-symbol generating unit 22 generates a histogram (reference numeral 501) representing a distribution of the action element symbols for eight seconds. Then, as shown in FIG. 6, the driving-action-symbol generating unit 22 clusters the histogram. As the clustering performed here as well, any method can be used. A result of the clustering is driving action symbols, which are a result obtained by classifying driving actions of the driver in eight seconds. A method of clustering data to acquire characteristics of a system in this way is called BoS (Bag of Systems). Note that the driving action symbols may be generated after the action element symbols are weighted.

The driving action symbols are stored in the storing unit 24 in association with position information. Specifically, as shown in FIG. 7, the driving action symbols are stored as a set of records together with a vehicle ID, date and time, position information, and the like. The records are referred to as driving action data. Note that, in this embodiment, a plurality of points are defined with respect to a road. Points representing traveling for eight seconds are specified and set as position information.

<Generation of Driving Tendency Symbols>

Figure 8:
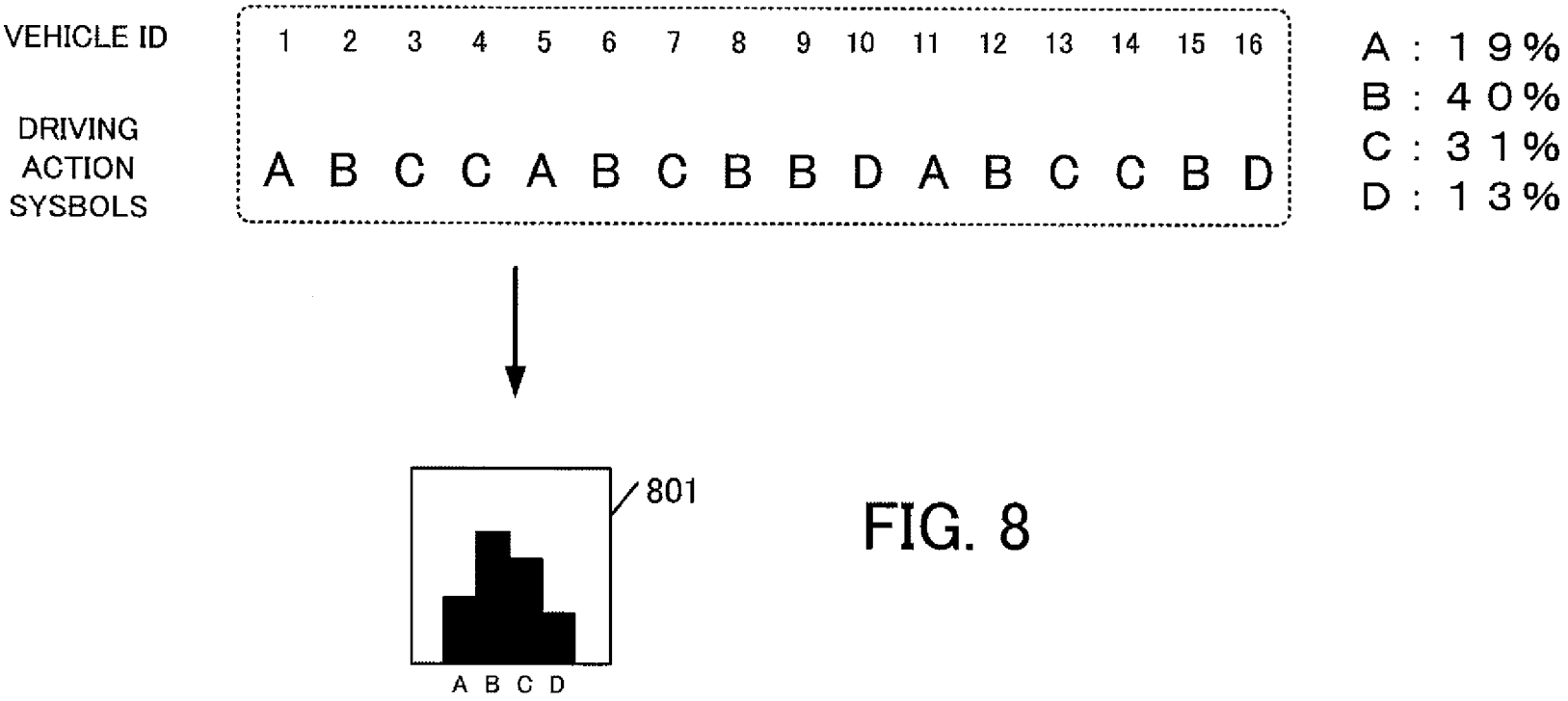
FIG. 8 is a diagram for explaining generation of a histogram of the driving action symbols.

The processing explained above is processing for acquiring driving actions corresponding to a single vehicle. Next, with reference to FIG. 8, the processing in which the driving-tendency-symbol generating unit 23 generates driving tendency symbols from driving action symbols corresponding to a plurality of vehicles is explained below.

First, the driving-tendency-symbol generating unit 23 acquires a plurality of driving action symbols for each of the points defined with respect to the road and generates a histogram (reference numeral 801) representing a distribution of the driving action symbols. In an example shown in FIG. 8, concerning the same point, the driving-tendency-symbol generating unit 23 converts a distribution of driving action symbols acquired from sixteen vehicles into a histogram. Then, the driving-tendency-symbol generating unit 23 performs clustering according to a method same as the generation of the driving action symbols (FIG. 6) to obtain a result. A result of the clustering is driving tendency symbols, which are symbols representing a tendency of driving actions of a plurality of drivers at a target point. Note that the driving tendency symbols may be generated after the driving action symbols are weighted.

The driving tendency symbols are stored in the storing unit 24 in association with position information. Specifically, as shown in FIG. 9, the driving tendency symbols are stored as a set of records together with date and time and the like. The record is referred to as driving tendency data.

When the processing explained above is performed for all the defined points, it is possible to generate the driving tendency symbols for each of the points defined with respect to the road.

<Output of the Driving Tendency Symbols>

The generated driving tendency symbols are provided to the user via the information presenting unit 25.

A method of providing the driving tendency symbols to the user is illustrated. In this embodiment, the information presenting unit 25 displays the roadmap stored in the storing unit 24 according to operation by the user. When displaying the roadmap, the information presenting unit 25 may perform processing for receiving an input of a driving route desired by the user or acquiring a driving route through a route search. Note that, although presentation of information is performed by displaying the roadmap in this embodiment, a presenting method for information is not limited to this. For example, the information may be output by sound or may be output in a data format transmitted to another system.

Figure 10:
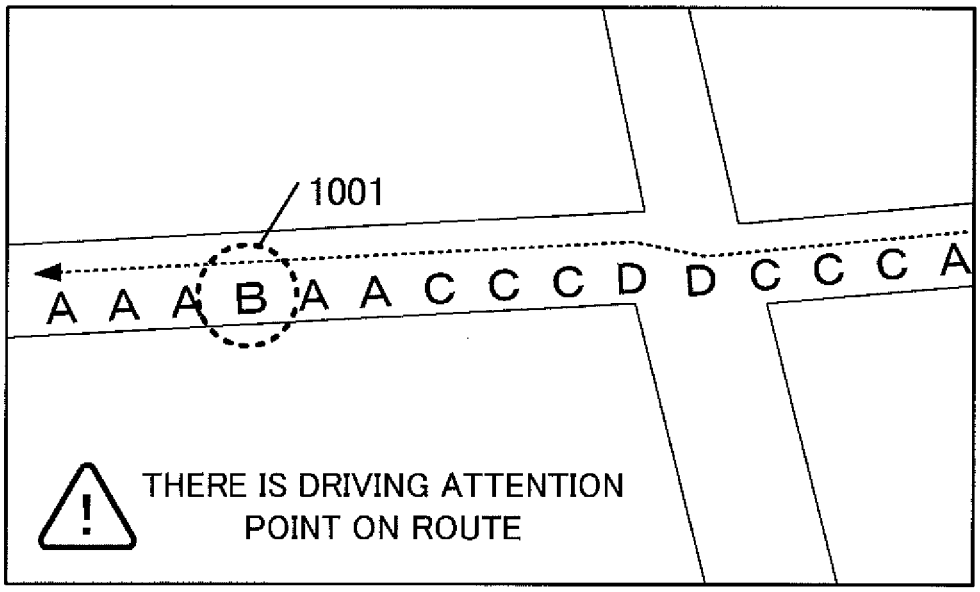
FIG. 10 is an example of a screen provided to a user.

The information presenting unit 25 acquires the driving tendency symbols stored in the storing unit 24, superimposes the driving tendency symbols on the roadmap, and outputs the driving tendency symbols to a screen. FIG. 10 is an example of the screen on which the driving tendency symbols are superimposed on the roadmap. Symbols A to D in FIG. 10 are the driving tendency symbols.

The driving tendency symbols are symbols representing a tendency of driving actions taken in places of the driving tendency symbols. Therefore, there is a characteristic that, when a driver takes a sudden driving action, the driving tendency symbols locally change. Therefore, by detecting the local change of the driving tendency symbols, it is possible to specify a point where attention is necessary for driving. For example, in the example shown in FIG. 10, it is seen that the driving tendency symbol temporarily changes at a point indicated by reference numeral 1001. At such a point, it is highly likely that many vehicles took some actions because of external factors such as "a vehicle running straight temporarily changed a traffic lane" and "a vehicle running at high speed temporarily reduced speed". Therefore, in this embodiment, the information presenting unit 25 detects that the driving tendency symbols on a route temporarily change and notifies the user of the change. Consequently, the user can obtain information concerning a place where attention is necessary for driving.

Note that the local change indicates that the changed driving tendency symbol returns to an original symbol within a predetermined time or distance.

<Processing Flowchart>

A processing flowchart for realizing the functions explained above is explained below.

Figure 11:
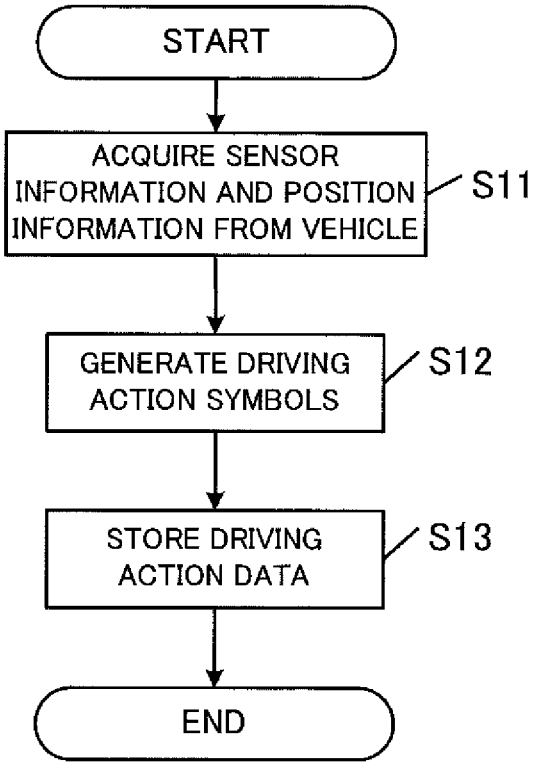
FIG. 11 is a flowchart for explaining generation processing for driving action data.

FIG. 11 is a flowchart of processing performed by the information providing system according to this embodiment. The processing is cyclically executed.

First, in step S11, the information providing apparatus 20 acquires sensor information and position information from the vehicle-mounted apparatus 10 mounted on the vehicle. Note that, although a plurality of vehicles may perform communication, a target vehicle is preferably moving (traveling). This is because it is useless to acquire sensor information from stopped vehicles.

Subsequently, in step S12, the driving-action-symbol generating unit 22 clusters the acquired sensor information to generate action element symbols and clusters the action element symbols to generate driving action symbols.

In step S13, the driving-action-symbol generating unit 22 causes the storing unit 24 to store the generated driving action symbols. As explained above with reference to FIG. 7, the driving action symbols are added in a record format for each of points on a road and for each of vehicles as driving action data.

According to the processing explained above, the driving action symbols corresponding to the vehicles and the points are acquired and stored.

Note that, in step S13, when driving action data older than a fixed number of days is present, a record corresponding to the driving action data may be deleted. By deleting the data that is old to a certain degree, it is possible to secure a storage capacity and secure freshness of data.

Figure 12:
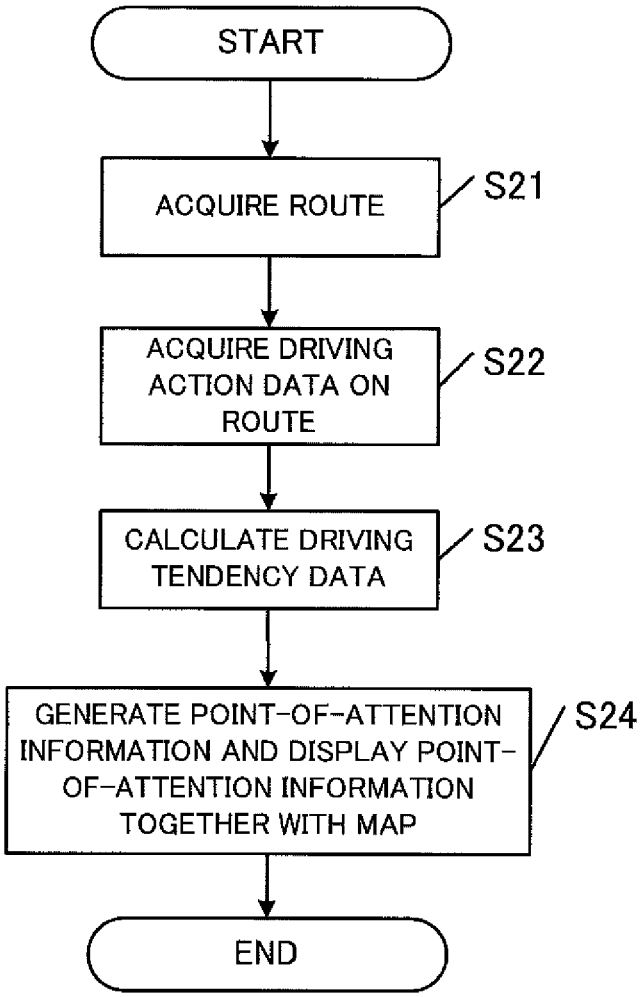
FIG. 12 is a flowchart for explaining generation processing for driving tendency data.

FIG. 12 is a flowchart of processing for calculating driving tendency data at a desired point on the basis of stored driving action data. In this embodiment, the processing is started by the user performing operation for designating a route on the roadmap and starting an analysis concerning the route.

First, in step S21, the driving-tendency-symbol generating unit 23 acquires a processing target route. The user may designate the route on the map as explained above. Alternatively, when the information providing system includes means for searching for a route between two points, the information providing system may automatically search for a route on the basis of a place of departure and a destination that the information providing system causes the user to input.

Subsequently, in step S22, the driving-tendency-symbol generating unit 23 extracts, from the storing unit 24, a plurality of driving action data corresponding to the designated route (that is, located on the route).

Subsequently, in step S23, the driving-tendency-symbol generating unit 23 clusters the extracted plurality of driving action data and generates driving tendency data. As a result, driving tendency symbols on the designated route are obtained. Note that, when generated driving tendency data is already stored in the storing unit 24, repeated generation may be omitted. However, since the driving action data is updated at any time, it is preferable to generate driving tendency data again if information is recognized as old.

Subsequently, in step S24, the information presenting unit 25 overlays, on a roadmap representing the designated route, for each of points, the driving tendency symbols corresponding to the route and outputs the driving tendency symbols. When overlaying and outputting the driving tendency symbols, the information presenting unit 25 generates point-of-attention information according to the method explained above and simultaneously overlays and displays the point-of-attention information on the map. Note that the driving tendency symbols may be displayed as characters or may be color-coded and displayed as lines. The point-of-attention information may be displayed as characters or may be displayed as a figure.

As explained above, the information providing system according to the first embodiment clusters sensor data acquired from the vehicle to acquire driving actions and clusters driving actions corresponding to a plurality of vehicles to acquire a driving tendency. Consequently, it is possible to typify driving actions taken on a target road. By detecting a place where sudden driving actions are taken, it is possible to provide information concerning a place where attention is necessary for driving.

Note that, in the example explained in the first embodiment, the driving action symbols are generated at every eight seconds and stored as the driving action symbols at the point corresponding thereto. However, the driving action symbols may be acquired at any interval. Similarly, a generation interval of the action element symbols is not limited to one second. It is also possible that sliding windows are used and the windows overlap each other.

(Modification of the First Embodiment)

In the first embodiment, the driving action symbols at every predetermined time are generated. On the other hand, this modification is an example in which a road is divided at predetermined length and managed as sections (segments) and driving action symbols are generated for each of the sections.

The configurations of the vehicle-mounted apparatus 10 and the information providing apparatus 20 in this modification are the same as the configurations in the first embodiment. Therefore, explanation of the components is omitted. Only processing different from the processing in the first embodiment is explained.

In this modification, a road is divided at every 30 m and driving action symbols are generated. Specifically, when the driving action symbols are generated in step S12, action element symbols (i.e., behaviors of the vehicle for one second) are collected by a number corresponding to the section of 30 m. Clustering of the action element symbols is performed to generate driving action symbols. For example, when the vehicle travels 30 m in ten seconds, ten action element symbols are clustered. It is possible to determine, on the basis of position information transmitted from a vehicle-mounted apparatus, how much distance the vehicle moves.

Consequently, it is possible to generate driving tendency symbols at every 30 m as well.

Note that, in the example explained in this modification, the driving action symbols and the driving tendency symbols are generated at every 30 m. However, section length may be any length. The driving action symbols may be generated at every predetermined time and the driving tendency symbols may be generated at every predetermined distance, or vice versa. The generation of the driving action symbols and the generation of the driving tendency symbols are independent kinds of processing. Therefore, generation units of the symbols do not have to always coincide with each other.

Second Embodiment

In the first embodiment, the driving action symbols are generated at every predetermined time. In the modification of the first embodiment, the driving action symbols are generated at every predetermined distance. On the other hand, a second embodiment is an embodiment in which a user can designate a unit of generation of driving action symbols.

The configurations of the vehicle-mounted apparatus 10 and the information providing apparatus 20 in the second embodiment are the same as the configurations in the first embodiment. Therefore, explanation of the configurations is omitted. Only processing different from the processing in the first embodiment is explained.

In the second embodiment, in steps S12 and S13, driving action symbols are not generated. The driving element symbols are directly stored in the storing unit 24. When the route is acquired in step S21, a unit of generation of the driving action symbols is acquired from the user (the user is caused to select the unit out of units such as 10 m, 20 m, and 30 m).

Before step S23 is executed, processing for generating driving action symbols from the action element symbols is performed on the basis of the unit designated by the user.

That is, in the processing shown in FIG. 11, only information concerning a behavior of the vehicle at every one second is collected. After the unit of calculation of driving action symbols is designated by the user, the generation of the driving action symbols and the driving tendency symbols is performed.

In the second embodiment, by performing the processing explained above, it is possible to acquire the driving tendency symbols in the unit desired by the user.

Third Embodiment

A third embodiment is an embodiment in which driving tendency symbols are not generated according to operation by a user but driving tendency symbols and point-of-attention information are automatically generated and then delivered to a vehicle.

Figure 13:
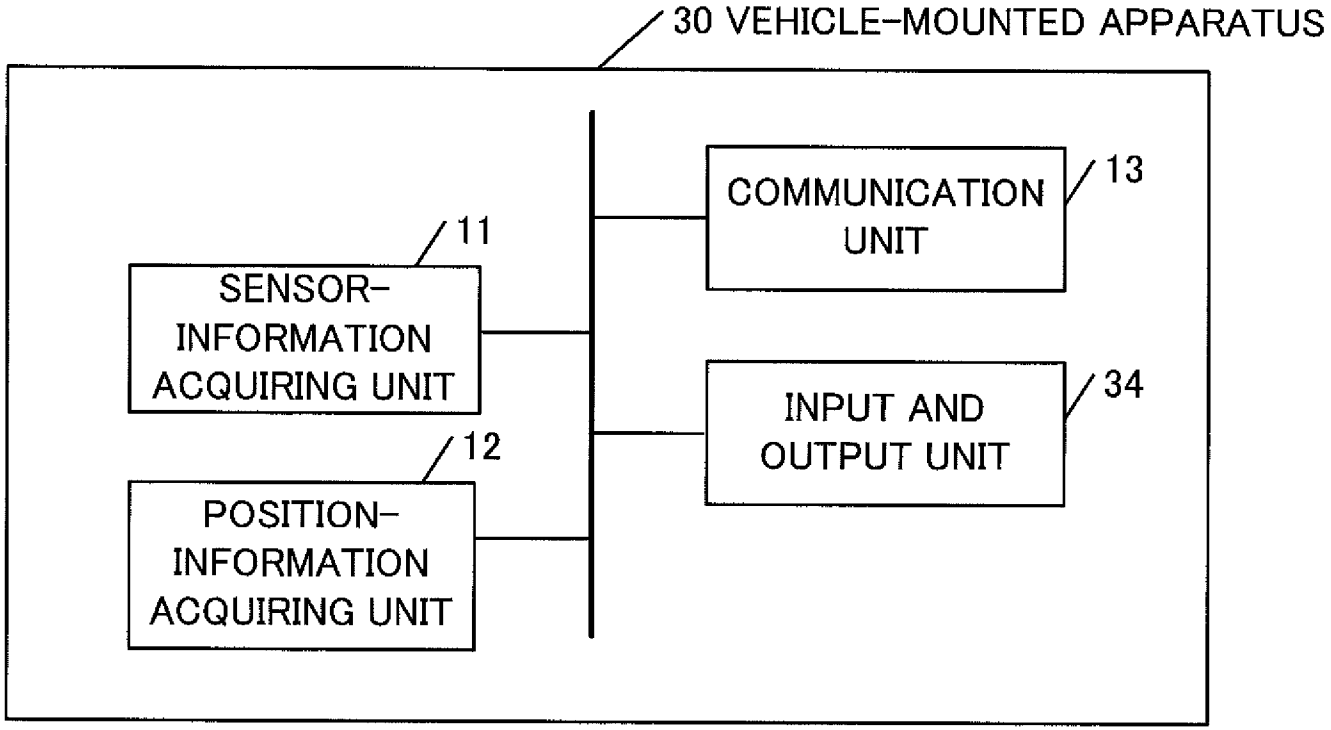
FIG. 13 is a system configuration diagram of a vehicle-mounted apparatus according to a second embodiment.

FIG. 13 is a system configuration diagram of a vehicle-mounted apparatus 30 according to the third embodiment. The vehicle-mounted apparatus 30 according to the third embodiment is different from the first and second embodiments in that the vehicle-mounted apparatus 30 further includes an input and output unit 34, which is means for performing input and output. The other means are the same as the means in the first and second embodiments.

The input and output unit 34 is means for receiving input operation performed by the user and presenting information to the user. Specifically, the input and output unit 34 is configured from a touch panel and control means for the touch panel and a liquid crystal display and control means for the liquid crystal display. In this embodiment, the touch panel and the liquid crystal display are made of one touch panel display.

Figure 14:
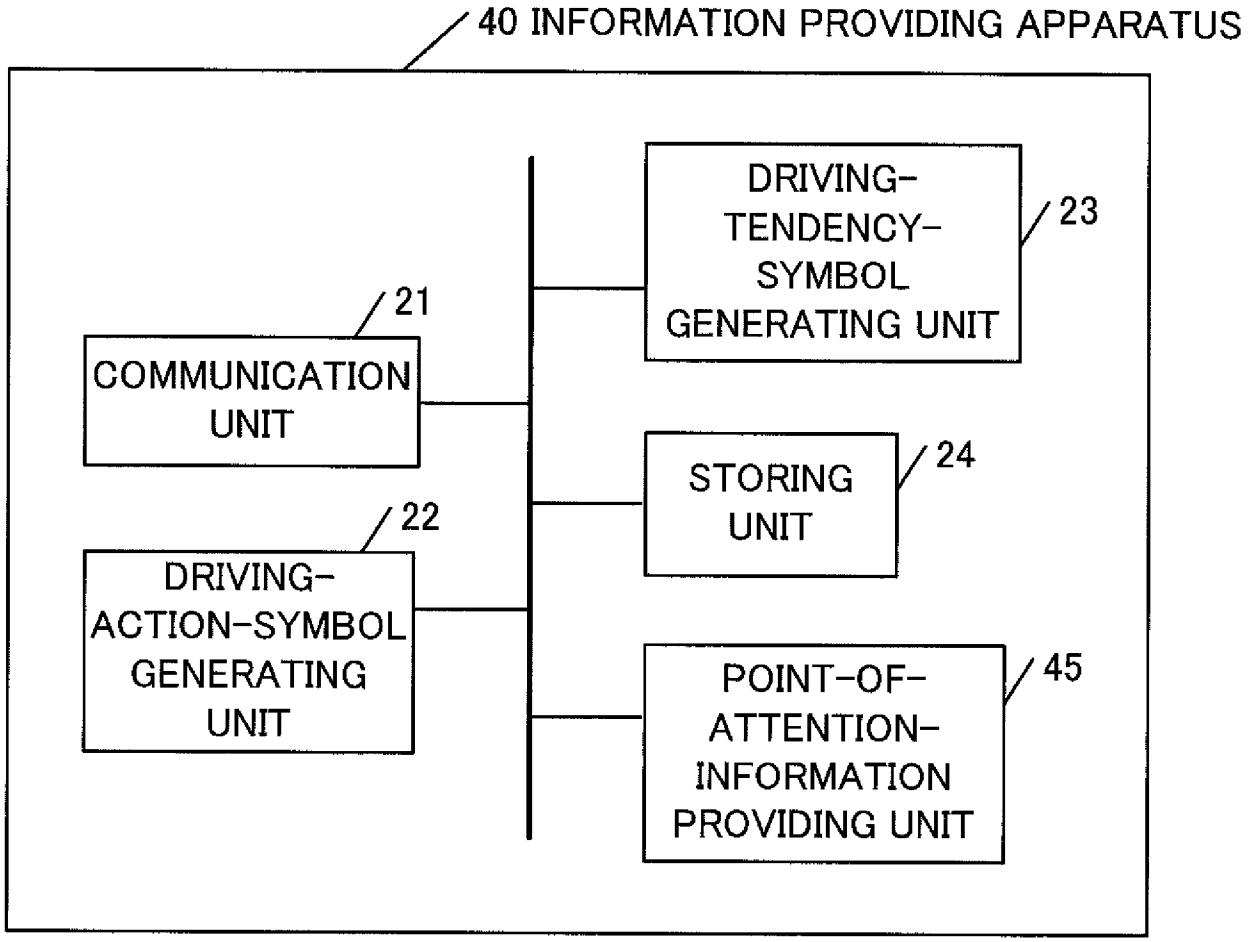
FIG. 14 is a system configuration diagram of an information providing apparatus according to the second embodiment.

FIG. 14 is a system configuration diagram of an information providing apparatus 40 according to the third embodiment. The information providing apparatus 40 according to the third embodiment is different from the first and second embodiments in that the information presenting unit 25 is replaced with a point-of-attention-information providing unit 45. The other means are the same as the means in the first and second embodiments.

The point-of-attention-information providing unit 45 is means for acquiring position information on a vehicle through the communication unit 21, determining, referring to the driving tendency data stored in the storing unit 24, whether there is a point of attention in the vicinity of the position (that is, whether there is a point where the driving tendency symbols temporarily change), and, when there is the point of attention, notifying the vehicle to that effect.

In the third embodiment, instead of performing the processing shown in FIG. 12, the information providing apparatus 40 cyclically acquires driving action data corresponding to all points. The information providing apparatus 40 cyclically generates driving tendency data and causes the storing unit 24 to store to store the driving tendency data (deletes old driving tendency data). Consequently, latest driving tendency data is always maintained.

In the processing shown in FIG. 11, after the execution of step S13, the point-of-attention-information providing unit 45 executes processing for determining presence or absence of a point of attention. Specifically, the point-of-attention-information providing unit 45 determines whether there is a point of attention forward in a direction in which a vehicle, which transmits information, is traveling. When there is the point of attention, the point-of-attention-information providing unit 45 notifies the vehicle-mounted apparatus 30 to that effect via the communication unit 21. Consequently, the driver is notified through the input and output unit 34. For example, the notification may be performed by screen display or may be performed by reproducing sound.

With the configuration explained above, on the basis of the driving action data collected from the vehicle, the information providing apparatus according to the third embodiment can automatically notify the vehicle that there is a place where attention is necessary for driving.

Note that, in the third embodiment, the vehicle that transmits the sensor information and the vehicle that receives the delivery of the information concerning the point of attention are the same. However, the vehicles may be different vehicles. In this case, it is sufficient to separately execute the processing shown in FIG. 1 (the processing for collecting sensor information and generating driving action data) and the processing for acquiring position information from the vehicle and determining presence or absence of a point of attention and then transmitting point-of-attention information.

Fourth Embodiment

In the first to third embodiments, when the generated driving tendency symbols locally change, it is determined that a peculiar driving action has occurred in the place. A fourth embodiment is an embodiment added with, in addition to the determination, processing for detecting that there is a driving action symbols contrary to an overall tendency among collected driving action symbols and determining that a peculiar driving action has occurred in a place corresponding to the driving action symbol.

System configurations of a vehicle-mounted apparatus and an information providing apparatus according to the fourth embodiment are the same as the system configurations in the first embodiment. Only differences of processing from the first embodiment are explained.

In the fourth embodiment, in step S24, in addition to the processing explained in the first embodiment, it is determined whether there is a vehicle driven contrary to an overall tendency and, when there is the vehicle, it is determined that peculiar driving has occurred in a place corresponding to the vehicle, and point-of-attention information is generated. The driving contrary to the overall tendency indicates that, for example, driving action symbols corresponding to the vehicle diverge from generated driving tendency symbols.

Specifically, the driving tendency symbols are symbols corresponding to a frequency distribution of the driving action symbols. Therefore, by acquiring a state of divergence between target driving action symbols and the frequency distribution, it is possible to determine that the driving contrary to the overall tendency is performed. For example, when a histogram corresponding to the generated driving tendency symbols deviates to a specific driving action symbol and there is a driving action symbol diverging from the deviation, it is seen that an event less likely to occur normally (e.g., rush-out from a side road) has suddenly occurred. That is, it is possible to determine that the place is a place where attention is necessary for driving. Note that the determination method for the divergence state is not limited to a specific method. For example, when it is possible to determine a distance between driving action symbols, an amount of the divergence may be determined using the distance.

In the fourth embodiment, it is determined on the basis of the state of divergence between the driving action symbol and the driving tendency symbol in the place corresponding to the driving action symbol whether point-of-attention information is generated. Therefore, even when only a part of vehicles performs peculiar driving, it is possible to generate the point-of-attention information.

Note that, even if only a few vehicles perform driving actions divergent from an overall tendency, when a divergence degree is large, it is preferable to increase weight used for the determination. Besides, it is also possible that a threshold is set for a ratio to the number of all vehicles and, when the number of vehicles that perform driving actions different from the overall tendency is larger than a predetermined ratio, the point-of-attention information is generated.

(Modifications)

The embodiments explained above are only examples. The present invention can be changed as appropriate and carried out without departing from the spirit of the present invention.

For example, in the first and second embodiments, every time a route is designated, the driving tendency data corresponding to the route is calculated on the basis of the stored driving action data. However, recalculation may be periodically performed targeting all roads to automatically calculate the driving tendency data.

In the explanation of the embodiments, the clusters are automatically generated. However, clusters associated with specific driving actions may be defined. In this case, additional information incidental to the driving tendency symbols may be stored and simultaneously notified to the user or the driver. For example, notification "a traffic lane change is often performed at this point" may be performed.

The user may determine with which driving actions the driving tendency symbols are associated and manually give additional information. For example, when point-of-attention information is generated, the user may check an onboard video photographed at the point and input a comment. When the comment is delivered to the vehicle together with the point-of-attention information, the driver of the vehicle can grasp a target for which attention is necessary.

In step S11, attributes of vehicles (or drivers) may be acquired and stored in association with the driving action symbols. When the driving action data is acquired in step S22, only data of vehicles (or drivers) having attributes matching conditions may be acquired. Consequently, for example, it is possible to filter data according to, for example, a car mode, a size of a vehicle, sex, age, driving experience of a driver, and the like.

Similarly, it is also possible that a period of time and a day of the week when sensor data is generated, division of a weekday and a holiday, and the like are acquired and stored in association with the driving action symbols and then the driving tendency data is generated using only data matching conditions. Consequently, since driving actions are considered to greatly change according a period of time and a day of the week, it is possible to obtain more accurate information.

These designation conditions may be set in advance or may be input every time the user performs operation.

In the embodiments, the driving tendency symbols are given to the points corresponding to the places where the sensor data is generated. However, the driving tendency symbols may be given to similar places. The similar places are places having similar characteristics of a road such as buildings around the road, width of the road, the number of traffic lanes, and a distance from a crossing. It is preferable that such characteristics can be acquired from map data.

In the embodiments, the information providing apparatus acquires the sensor data and the position information from the vehicle and generates the driving action symbols. However, the driving action symbols may be generated on the vehicle side. In this case, it is sufficient to provide the driving-action-symbol generating unit 22 on the inside of the vehicle-mounted apparatus 10 and, according to the processing explained above, generate the driving action symbols and then transmit position information corresponding to the generated driving action symbols.

In the example explained in the embodiments, the sensor data is transmitted on a real-time basis. However, the sensor data does not have to be transmitted on a real-time basis as long as the sensor data can be transmitted at predetermined timing. For example, the sensor data may be transmitted in every trip or may be transmitted according to a predetermined schedule. The sensor data does not always has to be transmitted by radio and may be exchanged off-line.

The modifications are the same when the diving action symbols are generated on the vehicle-mounted apparatus 10 side and transmitted.

In the explanation of the embodiments, the speed, the acceleration, the steering angle, and the yaw rate are illustrated as the information that can be acquired by the sensors. However, information other than the illustrated information may be used as long as states of the vehicle or the driver can be acquired. For example, the information may be a traveling track or a value of an odometer or may be biological information (a heart rate, etc.) or the like of the driver.

In the explanation of the embodiments, the example is explained in which the information concerning the places where the peculiar driving actions occur is presented to the user or the driver. However, other processing may be performed using the generated point-of-attention information. For example, a route with fewer points of attention may be searched and presented.

This application claims the benefit of Japanese Patent Application No. 2014-081263, filed on Apr. 10, 2014, which is hereby incorporated by reference herein in its entirety.

REFERENCE SIGNS LIST

10: VEHICLE-MOUNTED APPARATUS
11: SENSOR-INFORMATION ACQUIRING UNIT
12: POSITION-INFORMATION ACQUIRING UNIT
13,21: COMMUNICATION UNIT
20: INFORMATION PROVIDING APPARATUS
22: DRIVING-ACTION-SYMBOL GENERATING UNIT
23: DRIVING-TENDENCY-SYMBOL GENERATING UNIT
24: STORING UNIT
25: INFORMATION PRESENTING UNIT
34: INPUT AND OUTPUT UNIT
45: POINT-OF-ATTENTION-INFORMATION PROVIDING UNIT

The invention claimed is:

1. A driving action classifying apparatus comprising:
a processor programmed to:
acquire position information on a vehicle and driving action symbols for the vehicle, the driving action symbols for the vehicle being data obtained by classifying information obtained from a plurality of sensors on the vehicle into a plurality of classes represented by first symbols; and
collect driving action symbols corresponding to a same or similar place acquired from a plurality of vehicles and generate driving tendency symbols, the driving tendency symbols being data obtained by converting into a second symbol a frequency distribution of driving action symbols including the driving action symbols for the vehicle and the driving action symbols from the plurality of vehicles.

2. The driving action classifying apparatus according to claim 1, wherein the processor is programmed to:
acquire, from the vehicle including the plurality of sensors, sensor data and position information of the vehicle at a time when the sensor data is generated; and
generate, on the basis of the acquired sensor data, the driving action symbols for the vehicle, which are the data obtained by classifying the sensor data into the plurality of classes represented by the first symbols.

3. The driving action classifying apparatus according to claim 1, wherein the processor is programmed to:
specify, on the basis of a change of the driving tendency symbols and position information corresponding to the driving tendency symbols, a place where a peculiar driving action has occurred.

4. The driving action classifying apparatus according to claim 3, wherein the processor is programmed to:
when the driving tendency symbols locally change in a certain place, estimate that the peculiar driving action has occurred in the certain place.

5. The driving action classifying apparatus according to claim 1, wherein the processor is programmed to:
specify, on the basis of a state of divergence between the acquired driving action symbols for the vehicle and the driving tendency symbols in places corresponding to the acquired driving action symbols for the vehicle, a place where a peculiar driving action has occurred.

6. The driving action classifying apparatus according to claim 3, wherein the processor is programmed to:
acquire position information of a second vehicle different from the vehicle; and
transmit a notification to the second vehicle when the position information of the second vehicle relates to a position in a vicinity of the specified place where the peculiar driving action has occurred.

7. The driving action classifying apparatus according to claim 6, wherein the processor is programmed to:
store additional information associated with the driving tendency symbols; and
transmit, together with the notification, the additional information associated with the driving tendency symbols to the second vehicle.

8. The driving action classifying apparatus according to claim 1, wherein the processor is programmed to:
classify the position information into a plurality of segments and acquire the driving action symbols for the vehicle for each of the segments; and
generate the driving tendency symbols for each of the segments.

9. The driving action classifying apparatus according to claim 1, wherein the processor is programmed to:
associate attributes concerning situations during vehicle traveling with the acquired driving action symbols for the vehicle; and
generate the driving tendency symbols, using respective ones of the driving action symbols for the vehicle and the driving actions symbols from the plurality of vehicles, the respective ones being associated with attributes designated by a user.

10. The driving action classifying apparatus according to claim 9, wherein the attributes concerning the situations during the vehicle traveling are periods of time when the vehicle travels.

11. The driving action classifying apparatus according to claim 9, wherein the attributes concerning the situations during the vehicle traveling are attributes of a driver who drives the vehicle.

12. The driving action classifying apparatus according to claim 2, wherein:

the sensor data includes a plurality of data generated by the plurality of sensors; and the processor is programmed to cluster the plurality of data to generate the driving action symbols for the vehicle.

13. The driving action classifying apparatus according to claim 12, wherein the sensor data is at least one of speed, acceleration, a steering angle, and a yaw rate.

14. A driving action classifying method performed by a driving action classifying apparatus that classifies driving actions of a driver, the driving action classifying method comprising:

a driving-action-symbol acquiring step for acquiring position information on a vehicle and driving action symbols for the vehicle, the driving action symbols for the vehicle being data obtained by classifying information obtained from a plurality of sensors on the vehicle into a plurality of classes represented by first symbols; and a tendency symbolizing step for collecting driving action symbols corresponding to a same or similar place acquired from a plurality of vehicles and generating driving tendency symbols, the driving tendency symbols being data obtained by converting into a second symbol a frequency distribution of driving action symbols including the driving action symbols for the vehicle and the driving action symbols from the plurality of vehicles.

15. A vehicle-mounted terminal mounted on a vehicle including a plurality of sensors, the vehicle-mounted terminal comprising:

a processor programmed to:

acquire sensor data from the plurality of sensors;

generate, on the basis of the acquired sensor data, driving action symbols for the vehicle, which are data obtained by classifying the sensor data into a plurality of classes represented by first symbols; and acquire position information on the vehicle; and transmit the position information and the driving action symbols for the vehicle to a driving action classifying apparatus comprising a second processor programmed to:

acquire the position information on the vehicle and the driving action symbols for the vehicle from the vehicle-mounted terminal; and collect driving action symbols corresponding to a same or similar place acquired from a plurality of vehicles and generate driving tendency symbols, the driving tendency symbols being data obtained by converting into a second symbol a frequency distribution of driving action symbols including the driving action symbols for the vehicle and the driving action symbols from the plurality of vehicles.

16. The vehicle-mounted terminal according to claim 15, wherein:

the sensor data includes a plurality of data generated by the plurality of sensors; and the processor is programmed to cluster the plurality of data to generate the driving action symbols for the vehicle.

17. The vehicle-mounted terminal according to claim 16, wherein the sensor data is at least one of speed, acceleration, a steering angle, and a yaw rate.

* * * * *